US012252311B2

(12) United States Patent
Morciano et al.

(10) Patent No.: US 12,252,311 B2
(45) Date of Patent: Mar. 18, 2025

(54) LID-SPOUT ASSEMBLY FOR A PACKAGE AND PACKAGE HAVING A LID-SPOUT ASSEMBLY

(71) Applicant: TETRA LAVAL HOLDINGS & FINANCE S.A., Pully (CH)

(72) Inventors: Davide Morciano, Modena (IT); Paolo Zanon, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 188 days.

(21) Appl. No.: 17/913,918

(22) PCT Filed: Apr. 1, 2021

(86) PCT No.: PCT/EP2021/058619
§ 371 (c)(1),
(2) Date: Sep. 23, 2022

(87) PCT Pub. No.: WO2021/204671
PCT Pub. Date: Oct. 14, 2021

(65) Prior Publication Data

US 2023/0124456 A1 Apr. 20, 2023

(30) Foreign Application Priority Data

Apr. 9, 2020 (EP) ..... 20168899

(51) Int. Cl.
*B65D 5/74* (2006.01)
*B65D 47/08* (2006.01)
*B65D 51/22* (2006.01)

(52) U.S. Cl.
CPC ..... *B65D 5/746* (2013.01); *B65D 47/0876* (2013.01); *B65D 51/228* (2013.01);
(Continued)

(58) Field of Classification Search
CPC ... B65D 5/746; B65D 47/0876; B65D 51/228
(Continued)

(56) References Cited

U.S. PATENT DOCUMENTS 3,462,048 A * 8/1969 Henchert ..... B65D 47/148 D9/446
2019/0193894 A1 6/2019 Hauser et al.
(Continued)

FOREIGN PATENT DOCUMENTS

CN 109311560 A 2/2019
ES 2580980 A1 8/2016
(Continued)

OTHER PUBLICATIONS

International Search Report (PCT/ISA/210) and Written Opinion (PCT/ISA/237) mailed on Jun. 1, 2021, by the European Patent Office as the International Searching Authority for International Application No. PCT/EP2021/058619. (9 pages).
(Continued)

*Primary Examiner* — Paul R Durand
*Assistant Examiner* — Michael J. Melaragno
(74) *Attorney, Agent, or Firm* — BUCHANAN INGERSOLL & ROONEY PC

(57) ABSTRACT

There is described a lid-spout assembly for a package. The lid-spout assembly comprises at least a spout having a collar carrying a pouring outlet, a coupling ring arranged around a portion of the collar, a lid and a hinge element hinging the lid to the coupling ring. The lid is controllable between at least a closed configuration and an open configuration. The lid-spout assembly comprises an interaction assembly partially associated to the collar and partially associated to the lid and being designed such to determine a threshold force needed to be exceeded, in use, in order to control the lid from the closed configuration to the open configuration.

15 Claims, 5 Drawing Sheets

(52) U.S. Cl.
CPC ..... *B65D 2251/0025* (2013.01); *B65D 2251/0093* (2013.01)

(58) Field of Classification Search
USPC ..... 222/566
See application file for complete search history.

(56) References Cited

U.S. PATENT DOCUMENTS

| | | | | |
|---|---|---|---|---|
| 2023/0115201 | A1* | 4/2023 | Menozzi | B65D 47/0838 220/200 |
| 2023/0121259 | A1* | 4/2023 | Morciano | B65D 5/746 220/258.1 |
| 2023/0127158 | A1* | 4/2023 | Morciano | B65D 5/746 222/556 |
| 2023/0137895 | A1* | 5/2023 | Morciano | B65D 51/228 222/528 |
| 2024/0208699 | A1* | 6/2024 | Zanon | B65D 5/746 |

FOREIGN PATENT DOCUMENTS

| | | | |
|---|---|---|---|
| JP | H0423625 | U | 2/1992 |
| JP | 2008050054 | A | 3/2008 |
| JP | 2018-188213 | A | 11/2018 |

OTHER PUBLICATIONS

U.S. Appl. No. 17/914,059, filed Sep. 23, 2022, Davide Morciano et al.
U.S. Appl. No. 17/907,170, filed Sep. 23, 2022, Stefano Menozzi et al.
U.S. Appl. No. 17/913,943, filed Sep. 23, 2022, Davide Morciano et al.
U.S. Appl. No. 17/914,025, filed Sep. 23, 2022, Davide Morciano et al.
U.S. Appl. No. 17/914,119, filed Sep. 23, 2022, Paolo Zanon et al.
Office Action/Search Report (The First Office Action) issued on Jul. 31, 2024, in corresponding Chinese Patent Application No. 202180009772.X and English translation of the Office Action/Search Report. (20 pages).

* cited by examiner

LID-SPOUT ASSEMBLY FOR A PACKAGE AND PACKAGE HAVING A LID-SPOUT ASSEMBLY

TECHNICAL FIELD

The present invention relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a lid-spout assembly.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular sealed main bodies of the packages formed from the packaging material, comprise a designated pour opening, which allows the outpouring of the pourable product from the packages. Typically, the designated pour opening is covered by a separation membrane, which isolates the inside of the package from the outer environment and which is to be opened or to be removed or to be ruptured or to be cut or to be pierced prior to the first outpouring of the pourable product so as to allow for the outpouring of the pourable product through the designated pour opening. It is also known to arrange a lid-spout assembly on the main body about the designated pour opening.

There are known lid-spout assemblies, which comprise a spout having a pouring outlet so as to allow for a controlled outpouring of the pourable product from the package, a coupling ring arranged around a portion of the spout and a lid connected to the coupling ring and configured to allow to selectively close and open the pouring outlet.

The lid is designed to be controlled between a closed configuration and an open configuration in which the lid is configured to respectively cover and open the pouring outlet. In particular, the lid is arranged on the spout when being in the closed configuration and is detached from the spout when being in the open configuration.

Typically, the package is distributed to a consumer with the lid being in the closed configuration and with an intact separation membrane. The first time the consumer intends to pour at least some of the pourable product out of the package, the consumer needs to move the lid from the closed configuration to the open configuration and the separation membrane needs to be opened and/or removed.

Afterwards the consumer can repeatedly control the lid between the closed configuration and the open configuration until the package has been fully emptied and is finally disposed.

An inconvenience with packages having such kinds of lid-spout assembly has been found in that there are situations in which the lid can unwantedly move from the closed configuration to the open configuration (e.g. due to a falling of the package).

Thus, a desire is felt in the sector to provide for a lid-spout assembly, which does not come along with such inconveniences.

DISCLOSURE OF INVENTION

It is therefore an object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a package having a sealed main body, filled with a pourable product, even more particular filled with a pourable food product, which avoids any unwanted movement of the lid from the closed configuration to the open configuration.

It is a further object of the present invention to provide in a straightforward and low-cost manner a package, in particular a package having a sealed main body, filled with a pourable product, in particular filled with a pourable food product, having a lid-spout assembly, in particular the lid-spout assembly being designed to avoid any unwanted movement of the lid from the closed configuration to the open configuration.

According to the present invention, there is provided a lid-spout assembly according to the independent claim.

Further advantageous embodiments of the lid-spout assembly are specified in the respective dependent claims.

According to the present invention, there is also provided a package according to any one of claims 13 to 15.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
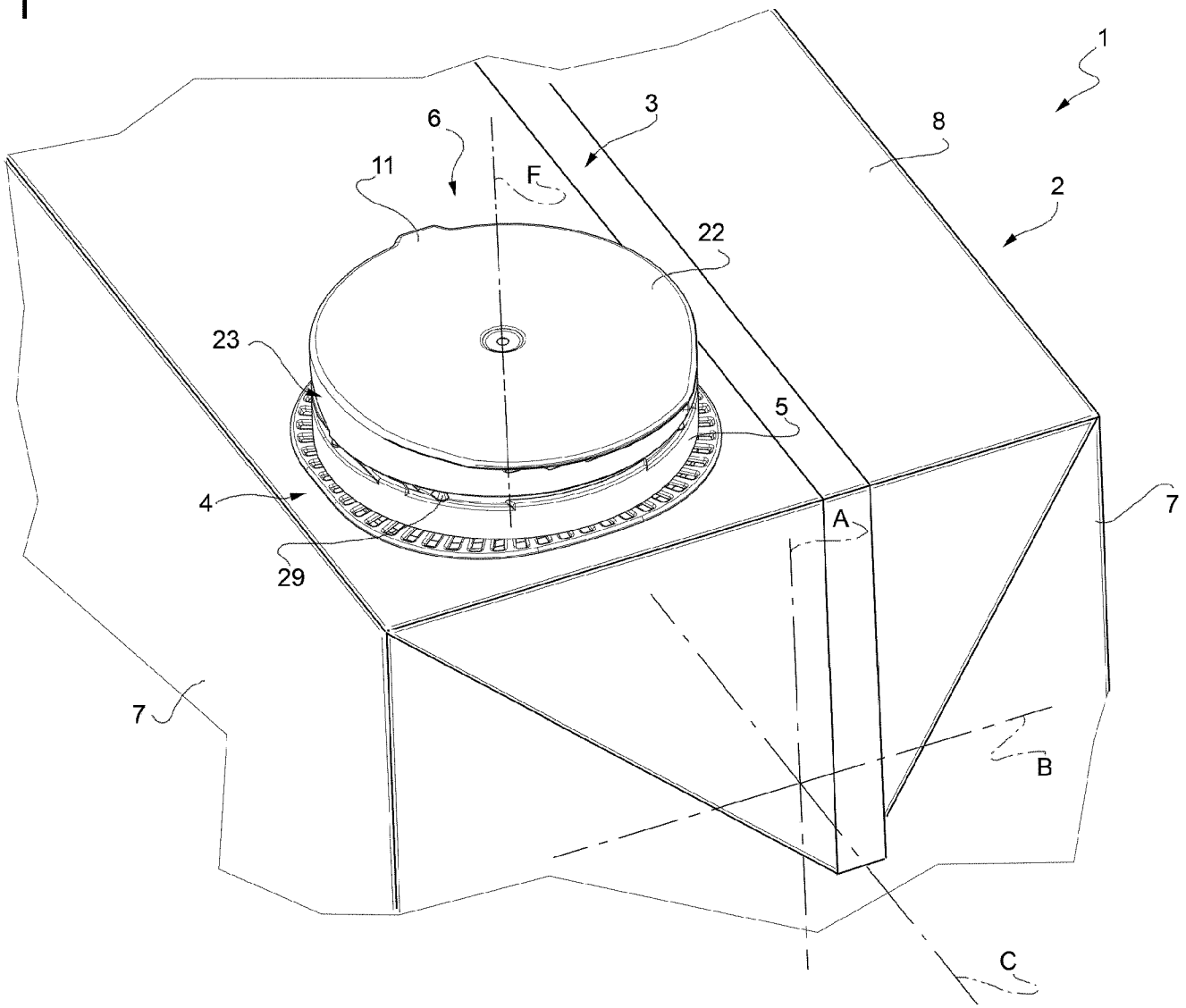
FIG. 1 is a schematic perspective view of a portion of a package having a lid-spout assembly according to the present invention, with parts removed for clarity.

Number 1 indicates as a whole a package (only partially shown to the extent necessary for the comprehension of the present invention) comprising:

a sealed main body 2, in particular a sealed carton package, being filled with a pourable product, in particular a pourable food product, and in particular having a designated pour opening (not shown and known as such) configured to allow for an outflow of the pourable product from main body 2; and a lid-spout assembly 3 coupled to the sealed main body 2 having at least a spout 4 arranged and/or arrangeable about the designated pour opening, a coupling ring 5 arranged around at least a portion of spout 4 and a lid 6 hinged to coupling ring 5 and coupled and/or couplable to spout 4.

According to some preferred non-limiting embodiments, main body 2 is obtained from a packaging material, in particular a composite packaging material, having a multi-layer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least one layer of fibrous material, such as e.g. a paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially, the packaging material also comprises a further layer of heat-seal plastic material being interposed between the layer of gas- and light-barrier material and the layer of fibrous material.

According to a preferred non-limiting embodiment, spout(s) 4 is (are) applied to base package(s) 2 prior, during or after the formation, filling and sealing of main body(ies) 2.

Alternatively, spout(s) 4 can be applied onto the packaging material prior to arranging the packaging material within or during advancement of the packaging material through a packaging machine for forming, filling and sealing main bodies 2 from the packaging material.

In particular, application of spout(s) 4 to the packaging material or to main body 2 occurs by means of a molding process and/or adhesive bonding and/or ultrasonic bonding.

Preferentially, coupling ring 5 and lid 6 are coupled to spout 4 prior or after application of spout 4 onto main body 2 or onto the packaging material.

With particular reference to FIG. 1, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion (not shown and known as such), in particular being transversal, even more particular perpendicular, to axis A, from which main body 2 extends along axis A. Preferably, the first wall portion defines a support surface of package 1, in particular main body 2, which is designed to be put in contact with a support surface, such as e.g. a shelf, when, in use, being e.g. exposed within a sales point or when being stored. In particular, when being arranged on a support surface the first wall portion defines a bottom wall portion.

Preferably, main body 2 also comprises a plurality of lateral walls 7 being (fixedly) connected to the first wall portion and extending, in particular substantially parallel to axis A, from the first wall portion.

Preferably, main body 2 also comprises a second wall portion 8 opposite to the first wall portion and being (fixedly) connected to at least some of lateral walls 7. In particular, lateral walls 7 are interposed between the first wall portion and second wall portion 8. In particular, when being arranged on a support second wall portion 8 defines a top wall portion.

According to some non-limiting embodiments, the first wall portion and second wall portion 8 may be parallel to one another.

According to a non-limiting alternative embodiment not shown, the first wall portion and second wall portion 8 could be inclined with respect to one another.

According to some non-limiting embodiments, second wall portion 8 carries and/or comprises the designated pour opening.

According to some preferred non-limiting embodiments, package 1, in particular main body 2, comprises an inner space 9 configured to contain and/or containing the pourable product. In particular, the first wall portion, lateral walls 7 and second wall portion 8 delimit inner space 9.

According to a preferred non-limiting embodiment, main body 2 comprises a separation membrane (not shown and known as such) covering the designated pour opening. In particular, the separation membrane separates in the area of, in particular at, the designated pour opening inner space 9 from the outer environment. Preferentially, the separation membrane comprises a gas- and light-barrier material, e.g. aluminum foil or ethylene vinyl alcohol (EVOH) film.

In particular, during the first-time use (see further below for more details), the separation membrane is at least partially removed and/or pierced and/or opened and/or ruptured and/or cut for allowing the pourable product to flow out of inner space 9 and main body 2.

According to a preferred non-limiting embodiment, the separation membrane is defined by a portion of the packaging material, in particular a portion of the layers of the packaging material being different from the layer of fibrous material.

With particular reference to FIGS. 1 to 5, lid-spout assembly 3 also comprises a hinge element 10 hinging lid 6 to coupling ring 5 and defining a hinge axis E around which lid 6 is angularly movable.

In particular, hinge element 10 is in contact with lid 6 at a rear portion 11 of lid 6.

Figure 2:
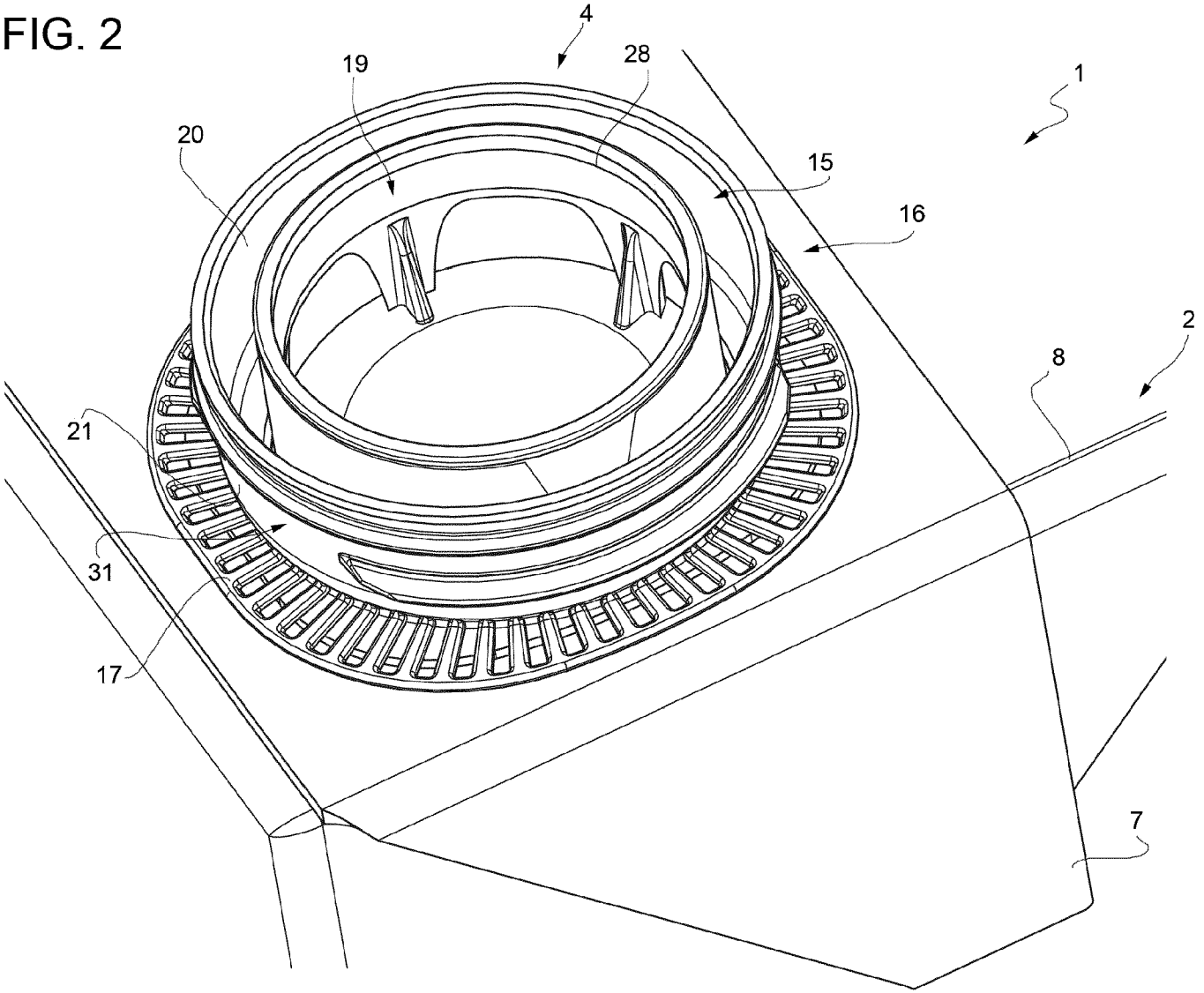
FIG. 2 is an enlarged perspective top view of a portion of the package of FIG. 1, with parts removed for clarity.
Figure 3:
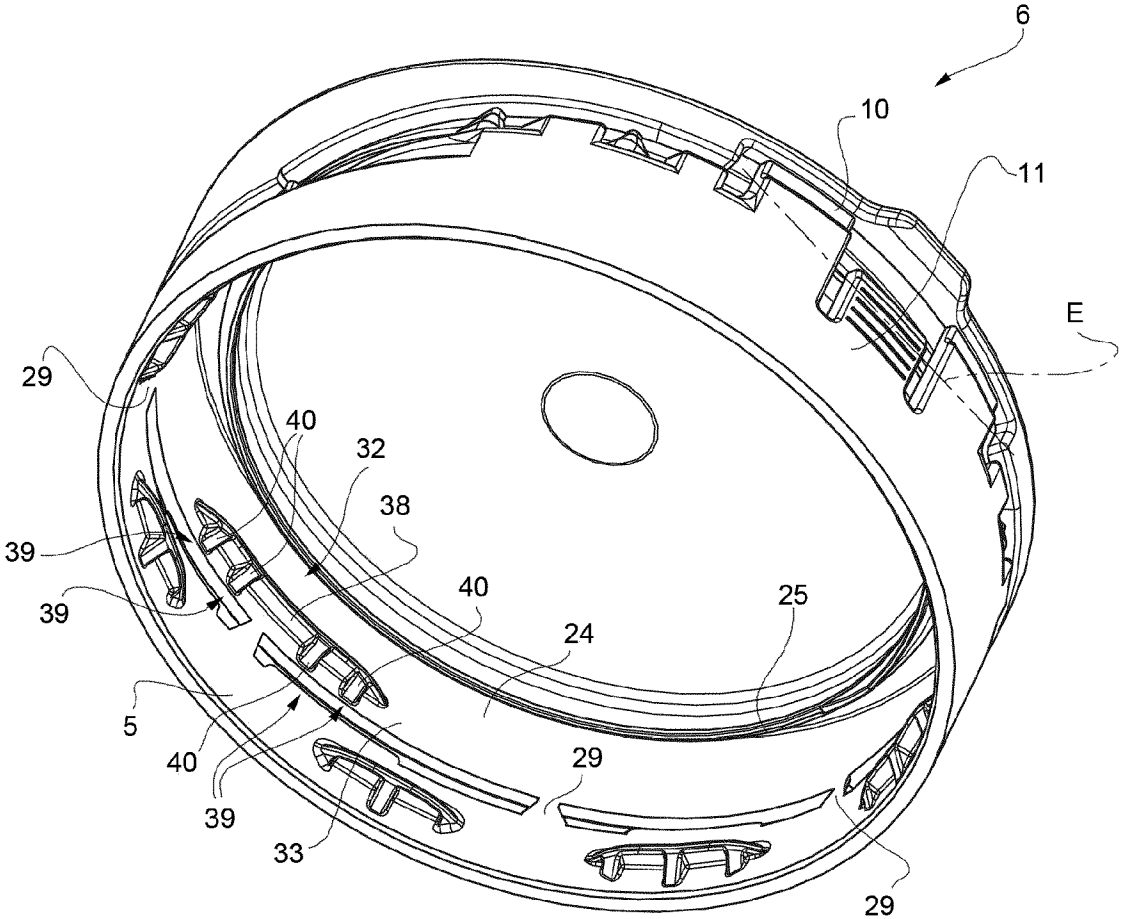
FIG. 3 is an enlarged perspective bottom view of a detail of the lid-spout assembly of FIG. 1, with parts removed for clarity.
Figure 4:
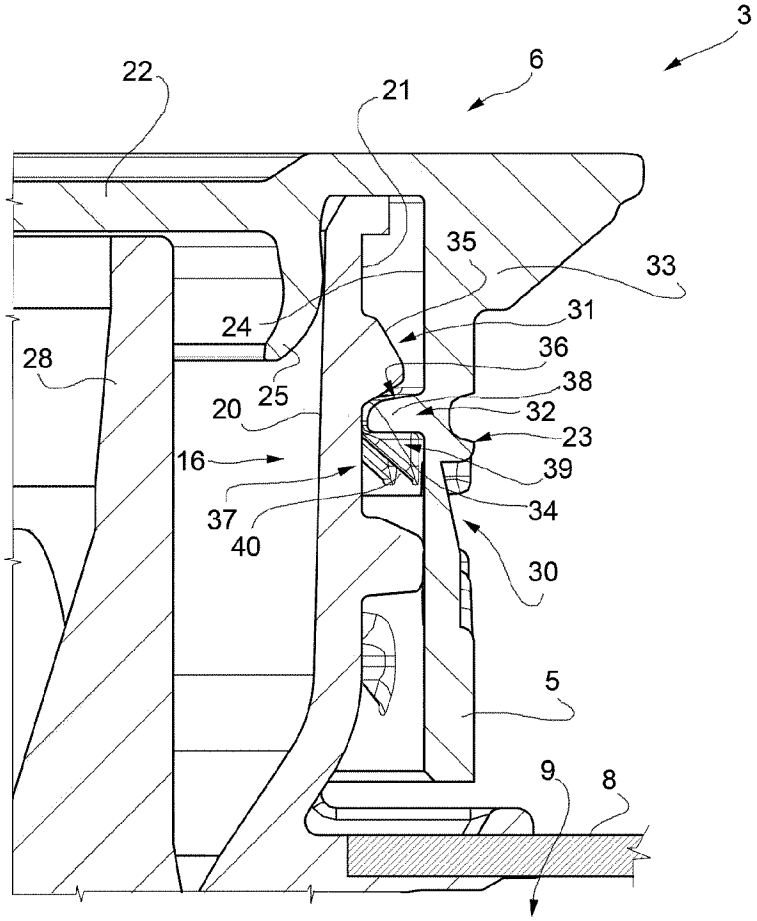
FIGS. 4 and 5 are sectionized views of some details of the lid-spout assembly of FIG. 1 being in different configurations, with parts removed for clarity.
Figure 5:
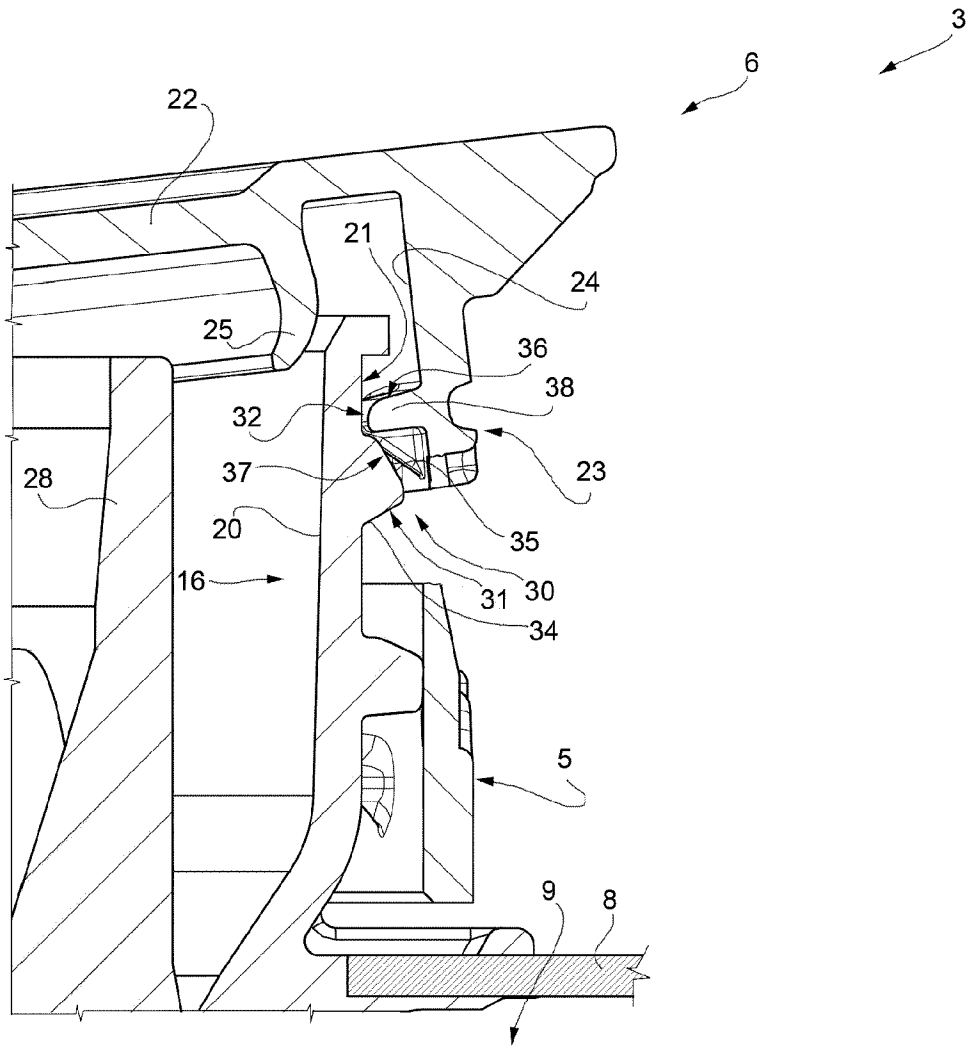

In more detail and with particular reference to FIGS. 2, 4 and 5, spout 4 comprises at least:

a pouring outlet 15 configured to allow for the outflow of the pourable product from package 1; and a collar 16 carrying (comprising) pouring outlet 15.

Preferentially, spout 4 also comprises a base frame 17 coupling and/or configured to couple spout 4 to main body 2, in particular to second wall portion 8, about the designated pour opening.

According to some preferred non-limiting embodiments, lid-spout assembly 3, in particular spout 4, coupling ring 5, lid 6 and hinge element 10, is/are formed and/or molded from a polymer. Preferentially, lid 6, hinge element 10 and coupling ring 5 are molded and/or molded separately from spout 4.

In more detail, collar 16 extends along a longitudinal axis F, in particular parallel to axis A, and carries (comprises) pouring outlet 15 at a first axial end of collar 16 itself and an inlet opening for the pourable product at a second axial end of collar 16 itself opposite to the first axial end. In particular, collar 16 delimits (and/or comprises) a flow channel 19 for the pourable product extending between the inlet opening and pouring outlet 15. In use, collar 16 is configured such to receive the pourable product from inner space 9 through the inlet opening and such that the pourable product flows out of pouring outlet 15.

Preferentially, collar 16 comprises an inner surface 20 delimiting flow channel 19 and an outer surface 21 opposite to inner surface 20.

In particular, collar 16 has a tubular configuration. Even more particular, collar 16 has an annular cross-sectional profile with respect to a cross-sectional plane perpendicular to longitudinal axis F.

Preferentially, hinge axis E and longitudinal axis F are transversal, in particular perpendicular to one another.

Preferentially, coupling ring 5 is arranged around at least a portion of collar 16. In particular, coupling ring 5 is rotatable around longitudinal axis F.

According to some preferred non-limiting embodiments, lid 6 is controllable between at least:

- a closed configuration, in which lid 6 is configured to cover and/or covers pouring outlet 15, in particular for impeding an outflow of the pourable product out of pouring outlet 15; and
- an open configuration in which lid 6 is configured to be and/or is detached from pouring outlet 15, in particular for allowing an outflow of the pourable product through pouring outlet 15.

Preferentially, lid 6 is in a first angular position and in a second angular position with respect to hinge axis E when being controlled respectively in the closed configuration and in the open configuration. In particular, lid 6 is controllable between the closed configuration and the open configuration by means of a pure angular movement of lid 6 around hinge axis E and between the first angular position and the second angular position.

It should be noted that within the scope of the present invention, a pure angular movement means that for angularly moving lid 6 about hinge axis E no rotation of lid 6 around a central axis being parallel, in particular coaxial, to longitudinal axis F with lid 6 being in the closed configuration, is required. In other words, it is possible to actuate the angular movement of lid 6 around hinge axis E while lid 6 is angularly fixed with respect to the central axis. According to such a definition, in the case the angular movement of lid 6 is actuated by means of a rotation around the central axis, the angular movement is not a pure angular movement.

It should be noted that package 1, immediately after its formation, is in an initial configuration in which lid 6 is in the closed configuration. Package 1 is distributed and/or sold to a consumer while being in the initial configuration.

According to some preferred non-limiting embodiments, lid 6 comprises a top wall 22 configured to cover pouring outlet 15 with lid 6 being controlled in the closed configuration and a side wall 23 protruding from top wall 22 and being configured to at least partially surround collar 16 with lid 6 being arranged in the closed configuration.

Preferentially, top wall 22 and side wall 23 delimit an internal space having a (substantially) cylindrical shape. In particular, the internal space houses at least a portion of collar 16 (and flow channel 19) with lid 6 being arranged in the closed configuration.

In particular, side wall 23 comprises an inner surface 24 facing inner surface 20 of collar 16 with lid 6 being arranged in the closed configuration.

Preferentially, lid 6 also comprises a sealing ring 25 protruding from top wall 22. In particular, sealing ring 25 is configured to interact with collar 16 so as to laterally seal pouring outlet 15 with lid 6 being in the closed configuration.

In particular, with lid 6 being in the closed configuration sealing ring 25 protrudes into flow channel 19 and laterally contacts a rim delimiting pouring outlet 15 of collar 16.

According to some preferred non-limiting embodiments, lid-spout assembly 3 also comprises an opening arrangement 28 coupled to lid 6 and configured to at least partially open and/or cut and/or rupture and/or remove the separation membrane during the first-time control of lid 9 from the closed configuration to the open configuration.

According to the non-limiting embodiment shown, opening arrangement 28 comprises a (polymer) covering layer fused and/or connected to the separation membrane and/or defining at least partially the separation membrane and a coupling member connected to the covering layer and lid 6. In use, the angular movement of lid 6 around hinge axis E also leads to an angular movement of the covering layer and the separation membrane around hinge axis E.

Alternatively, opening arrangement 28 could be in the form of a cutter or a strapping element could be connected and/or fused to the separation membrane and which the consumer could remove together with the separation membrane from package 1.

Preferentially, lid-spout assembly 3 also comprises one or more rupturable coupling bridges 29 connecting coupling ring 5 and lid 6 with one another. Coupling bridges 29 are designed to irreversibly rupture during the first control of lid 6 from the closed configuration to the open configuration. In this manner, lid-spout assembly 3 provides for a tamper-evidence.

Advantageously and with particular reference to FIGS. 2 to 5, lid-spout assembly 3 comprises an interaction assembly 30 partially associated to collar 16 and partially associated to lid 6 and being designed such to determine a threshold force needed to be exceeded, in use, in order to control lid 6 from the closed configuration to the open configuration. In particular, interaction assembly 30 is designed such that a consumer needs to apply to lid 6 an opening force that is larger than the threshold force in order to angularly move lid 6 around hinge axis E and from the first angular position to the second angular position.

In particular, the threshold force is such that any unwanted and/or undesired control of lid 6 from the first angular position to the second angular position, which would possibly lead to an unwanted and/or undesired outflow of the pourable product out of pouring outlet 15, is avoided.

In particular, partially associated means that a portion of interaction assembly 30 is associated, in particular connected to, collar 16 and another portion is associated, in particular connected to lid 6.

Preferentially, interaction assembly 30 is also designed to determine an auxiliary threshold force required to be exceeded, in use, in order to control lid 6 from the open configuration to the closed configuration whereby the threshold force is larger than the auxiliary threshold force. In particular, interaction assembly 30 is configured such to facilitate the angular movement of lid 6 from the second angular position to the first angular position.

With particular reference to FIGS. 2 to 5, interaction assembly 30 comprises an interaction member 31 associated to collar 16 and an interaction element 32 associated to lid 6. In particular, interaction member 31 and interaction element 32 are configured to interact with one another so as to define the threshold force, and in particular the auxiliary threshold force.

Preferentially, interaction member 31 and interaction element 32 are configured such to interact with one another during an angular movement of lid 6 from the first angular position to the second angular position so as to determine the threshold force, and in particular from the second angular position to the first angular position so as to determine the auxiliary threshold force.

According to some preferred non-limiting embodiments, interaction member 31 is connected, in particular integrally connected, to collar 16, in particular to outer surface 21. Preferentially, interaction member 31 (radially) protrudes (away) from outer surface 21. In particular, interaction member 31 protrudes in a direction radially away from longitudinal axis F.

Preferentially, interaction member 31 is ring-shaped. In particular, interaction member 31 is coaxial to longitudinal axis F.

According to some preferred non-limiting embodiments, interaction element 32 is connected, in particular integrally connected, to lid 6, in particular to a front portion 33 of lid 6 opposite to rear portion 11.

Please note that the terms "rear" and "front" can be understood in the context on how the consumer keeps package 1 at least during the first-time control of lid 6 from the closed configuration to the open configuration. Under such a condition front portion 33 is interposed between the consumer and rear portion 11.

Please also note that rear portion 11 is defined as the portion of lid 6 that is in contact with hinge element 10 and front portion 33 is the portion of lid 6 opposite to rear portion 10.

Preferentially, interaction element 32 is connected to side wall 23, in particular to inner surface 24. Even more particular, interaction element 32 protrudes away from inner surface 24 (and towards outer surface 21 with lid 6 being in the closed configuration.

Preferentially, interaction element 32 is positioned within the internal space.

Preferentially, interaction member 31 comprises a first sliding surface 34, and in particular a second sliding surface 35 opposite to first sliding surface 34.

Preferentially, interaction element 32 comprises a first engagement surface 36, and in particular a second engagement surface 37.

In particular, interaction member 31 and interaction element 32 are configured such that first sliding surface 34 and first engagement surface 36 interact with one another during control of lid 6 from the closed configuration to the open configuration and/or during movement of lid 6 around hinge axis E and from the first angular position to the second angular position.

In more detail and with particular reference to FIG. 4, during the exertion of an opening force for angularly moving lid 6 from the first angular position to the second angular position first engagement surface 36 abuts against first sliding surface 34 impeding the angular movement of lid 6 if the opening force is below or equals the threshold force and slides over first sliding surface 34 if the opening force exceeds the threshold force.

In more detail and with particular reference to FIG. 5, during the exertion of a closing force for angularly moving lid 6 from the second angular position to the first angular position second engagement surface 37 slides over second sliding surface 35, in particular if the closing force exceeds the auxiliary threshold force.

According to some preferred non-limiting embodiments, first sliding surface 34 has a first slope and second sliding surface 35 has a second slope being greater than the first slope.

According to some preferred non-limiting embodiments, respective (imaginary) projections of first engagement surface 36 and first sliding surface 34 intersect such to define an angle between 10° to 30° with lid 6 being arranged in the closed configuration.

According to some preferred non-limiting embodiments, interaction element 32 comprises a main wall 38 transversal, in particular (substantially) perpendicular, to longitudinal axis F and carrying first engagement surface 36.

Preferentially, wall 38 has a plate-like shape.

Preferentially, interaction element 32 further comprises one or more auxiliary walls 39 transversal, in particular perpendicular, to main wall 38.

In particular, auxiliary walls 39 are (substantially) parallel to longitudinal axis F with lid 6 being controlled in the closed configuration.

In particular, auxiliary walls 39 are connected at a respective first end of auxiliary walls 39 to main wall 38.

Preferentially, a respective radial extension of auxiliary walls 39 (with respect to a central axis of lid 6 being parallel to longitudinal axis F with lid 6 being in the closed configuration) is larger at the respective first end than at a respective second end of the respective auxiliary wall 39 opposite to the respective first end. In particular, each auxiliary wall 39 is arranged such that the respective first end is closer to top wall 22 than the respective second end.

In particular, main wall 38 is interposed between top wall 22 and auxiliary walls 39.

Preferentially, each auxiliary wall 39 comprises a respective lateral surface 40 facing outer surface 21 with lid 6 being in the closed configuration.

Preferentially, auxiliary walls 39 carry at least a portion of second engagement surface 37. In particular, lateral surfaces 40 define at least a portion of second engagement surface 37.

According to some preferred non-limiting embodiments and with particular reference to FIG. 5, sealing ring 25 is designed such that, in use, during control of lid 6 from the closed configuration to the open configuration and immediately after disengagement of first engagement surface 36 from first sliding surface 34 an aperture is delimited between sealing ring 25 and collar 16 so as to allow for air to enter flow channel 19. This is advantageous so that portions of the pourable product present within flow channel (after the first time lid 6 has been controlled from the closed configuration to the open configuration) 19 may flow back into main body 2.

In use, the outpouring of the pourable product from package 1 requires controlling lid 6 from the closed configuration to the open configuration. This means that the consumer needs to exert an opening force onto lid 6 for angularly moving lid 6 around hinge axis E and from the first angular position to the second angular position.

However, the opening force must exceed the threshold force in order to successfully move lid 6 from the first angular position to the second angular position as otherwise interaction assembly 30 guarantees that lid 6 remains in the closed configuration (and in the first angular position).

The first time lid 6 is controlled from the closed configuration to the open configuration also opening arrangement 28 is actuated so that the separation membrane loses its integrity and the pourable product can flow out of inner space 9.

Additionally, also coupling bridges 29 rupture. When controlling lid 6 from the open configuration to the closed configuration, the consumer must exert a closing force, which must exceed the auxiliary threshold force so that lid 6 moves from the second angular position to the first angular position.

The advantages of lid-spout assembly 3 and/or of package 1 according to the present invention will be clear from the foregoing description.

In particular, by providing for interaction assembly 30 any unwanted angular movement of lid 6 from the first angular position to the second angular position is avoided. In order to angularly move lid 6 from the first angular position to the second angular position, it is needed to exert the required opening force.

A particular advantage resides in placing interaction element 32 such that it is opposite to hinge element 10.

It is a further advantage to design interaction assembly 30 such that the auxiliary threshold force is lower than the threshold force in order to facilitate the angular movement of lid 6 from the second angular position to the first angular position.

Another advantage resides in that any unwanted movement of lid 6 from the closed configuration to the open configuration is avoided. This is in particular advantageous to avoid that lid 6 moves to the open configuration as a result of a falling of package 1.

A further advantage is seen in that a "click"-sound is generated during the angular movement of lid 7 from the open configuration to the closed configuration as a result of the mutual interaction of interaction member 31 and interaction element 32. This gives to the user a sound indication that the lid has been controlled in the closed configuration.

Clearly, changes may be made to lid-spout assembly 3 and/or package 1 as described herein without, however, departing from the scope of protection as defined in the accompanying claims.

The invention claimed is:

1. Lid-spout assembly for a package having a designated pour opening and being filled with a pourable product;

the lid-spout assembly comprises at least:

a spout having a collar carrying a pouring outlet;

a coupling ring arranged around a portion of the collar;

a lid configured to selectively close and open the pouring outlet; and a hinge element hinging the lid to the coupling ring and defining a hinge axis around which the lid is angularly movable;

wherein the lid is controllable between at least:

a closed configuration in which the lid is in a first angular position with respect to the hinge axis and in which the lid is configured to cover and/or covers the pouring outlet; and an open configuration in which the lid is in a second angular position with respect to the hinge axis and in which the lid is configured to open the pouring outlet;

wherein the lid-spout assembly is designed such that the lid is controllable between the closed configuration and the open configuration by means of an angular movement around the hinge axis;

wherein the lid-spout assembly comprises an interaction assembly partially associated to the collar and partially associated to the lid;

wherein the interaction assembly is designed such to determine a threshold force needed to be exceeded, in use, in order to control the lid from the closed configuration to the open configuration, wherein the interaction assembly comprises an interaction member associated to the collar and an interaction element associated to the lid, wherein the interaction member and the interaction element are configured to interact with one another so as to define the threshold force, wherein the interaction member comprises a first sliding surface and the interaction element comprises a first engagement surface, wherein the first sliding surface and the first engagement surface are designed such that during the exertion of an opening force for angularly moving the lid from the first angular position to the second angular position the first engagement surface abuts against the first sliding surface impeding the angular movement if the opening force is below or equals the threshold force and slides over the first sliding surface if the opening force exceeds the threshold force.

2. Lid-spout assembly according to claim 1, wherein the interaction assembly is also designed to determine an auxiliary threshold force required to be exceeded, in use, in order to control the lid from the open configuration to the closed configuration;

wherein the threshold force is larger than the auxiliary threshold force.

3. Lid-spout assembly according to claim 2, wherein the interaction member is ring-shaped.

4. Lid-spout assembly according to claim 2, wherein the lid comprises a top wall configured to cover the pouring outlet with the lid being in the first angular position and a side wall protruding from the top wall;

wherein the collar comprises an outer surface and the side wall comprises an inner surface facing the outer surface with the lid being in the first angular position;

wherein the interaction member protrudes from the outer surface and the interaction element protrudes from the inner surface.

5. Lid-spout assembly according to claim 2, wherein the hinge element is connected to a rear portion of the lid and the interaction element is connected to a front portion of the lid opposite to the rear portion.

6. Package according to claim 5, wherein the package further comprises a main body having the designated pour opening and being formed from a multilayer composite packaging material.

7. Lid-spout assembly according to claim 1, wherein the collar extends along a longitudinal axis;

wherein the interaction element comprises a main wall transversal to the longitudinal axis and carrying the first engagement surface.

8. Lid-spout assembly according to claim 7, wherein the interaction element further comprises one or more auxiliary walls transversal to the main wall;

wherein the auxiliary walls carry a second engagement surface opposite to the first engagement surface and configured to engage and slide over a second sliding surface of the interaction member during control of the lid from the open configuration to the closed configuration.

9. Lid-spout assembly according to claim 1, wherein with the lid being arranged in the first angular position, projections of the first engagement surface and the first sliding surface intersect such to define an angle between 10° to 30°.

10. Lid-spout assembly according to claim 1, wherein the interaction member comprises a second sliding surface opposite to the first sliding surface and the interaction element comprises a second engagement surface opposite to the first engagement surface configured to engage and slide over the second sliding surface during control of the lid from the open configuration to the closed configuration;

wherein the second sliding surface and the second engagement surface are designed such to promote the angular movement from the second angular position to the first angular position.

11. Lid-spout assembly according to claim 10, wherein the first sliding surface has a first slope and the second sliding surface has a second slope;

wherein the first slope is smaller than the second slope.

12. Package filled with a pourable product comprising at least one lid-spout assembly according to claim 1.

13. Package according to claim 12, and further comprising a separation membrane covering the designated pour outlet;

wherein the lid-spout assembly is fused and/or welded and/or bond to the package and around the designated pour outlet.

14. Lid-spout assembly for a package having a designated pour opening and being filled with a pourable product;

the lid-spout assembly comprises at least:

a spout having a collar carrying a pouring outlet;

a coupling ring arranged around a portion of the collar;

a lid configured to selectively close and open the pouring outlet; and a hinge element hinging the lid to the coupling ring and defining a hinge axis around which the lid is angularly movable;

wherein the lid is controllable between at least:

a closed configuration in which the lid is in a first angular position with respect to the hinge axis and in which the lid is configured to cover and/or covers the pouring outlet; and an open configuration in which the lid is in a second angular position with respect to the hinge axis and in which the lid is configured to open the pouring outlet;

wherein the lid-spout assembly is designed such that the lid is controllable between the closed configuration and the open configuration by means of an angular movement around the hinge axis;

wherein the lid-spout assembly comprises an interaction assembly partially associated to the collar and partially associated to the lid;

wherein the interaction assembly is designed such to determine a threshold force needed to be exceeded, in use, in order to control the lid from the closed configuration to the open configuration, wherein the interaction assembly is also designed to determine an auxiliary threshold force required to be exceeded, in use, in order to control the lid from the open configuration to the closed configuration;

wherein the threshold force is larger than the auxiliary threshold force.

15. Lid-spout assembly for a package having a designated pour opening and being filled with a pourable product;

the lid-spout assembly comprises at least:

a spout having a collar carrying a pouring outlet, wherein the collar comprises an inner surface and an outer surface opposite to inner surface;

a coupling ring arranged around a portion of the collar;

a lid configured to selectively close and open the pouring outlet; and a hinge element hinging the lid to the coupling ring and defining a hinge axis around which the lid is angularly movable;

wherein the lid is controllable between at least:

a closed configuration in which the lid is in a first angular position with respect to the hinge axis and in which the lid is configured to cover and/or covers the pouring outlet; and an open configuration in which the lid is in a second angular position with respect to the hinge axis and in which the lid is configured to open the pouring outlet;

wherein the lid-spout assembly is designed such that the lid is controllable between the closed configuration and the open configuration by means of an angular movement around the hinge axis;

wherein the lid comprises:

a top wall configured to cover the pouring outlet with the lid being controlled in the closed configuration, a side wall protruding from the top wall and being configured to at least partially surround the collar with the lid being arranged in the closed configuration, and a sealing ring protruding from the top wall, wherein the lid-spout assembly comprises an interaction assembly partially associated to the collar and partially associated to the lid;

wherein the interaction assembly comprises an interaction member associated to the collar, protruding from the outer surface of the collar, and an interaction element associated to the lid;

wherein the interaction assembly is designed such to determine a threshold force needed to be exceeded, in use, in order to control the lid from the closed configuration to the open configuration;

wherein the interaction member and the interaction element are configured to interact with one another so as to define the threshold force;

wherein the sealing ring, with the lid being in the closed configuration, is configured to interact with the collar so as to laterally seal the pouring outlet, protrudes into a flow channel delimited by the inner surface of the collar, and laterally contacts a rim of the collar delimiting the pouring outlet.

* * * * *